United States Patent [19]

Clare et al.

[11] 4,014,687

[45] Mar. 29, 1977

[54] PROCESS FOR MAKING MAGNESIUM METAL

[75] Inventors: Norval D. Clare, Niagara Falls, N.Y.; Charles H. Lemke, Newark, Del.

[73] Assignee: E. I. Du Pont de Nemours and Company, Wilmington, Del.

[22] Filed: Jan. 13, 1976

[21] Appl. No.: 648,761

[52] U.S. Cl. ..... 75/67 R; 75/10 A

[51] Int. Cl.[2] ..... C22B 29/00

[58] Field of Search ..... 75/67 R, 67 A, 10 A

[56] References Cited

UNITED STATES PATENTS 45,370 12/1864 Sonstadt ..... 75/67

FOREIGN PATENTS OR APPLICATIONS 574,092 12/1945 United Kingdom ..... 75/67 R

*Primary Examiner*—M. J. Andrews

[57] ABSTRACT

Magnesium metal is made by injecting sodium metal beneath the surface of a magma of $MgCl_2$ and withdrawing molten magnesium metal from the magma surface.

8 Claims, 2 Drawing Figures

PROCESS FOR MAKING MAGNESIUM METAL

FIELD OF THE INVENTION

The invention relates to a process for making magnesium metal by reacting magnesium chloride ($MgCl_2$) with sodium metal. The invention also relates to a reactor for carrying out the process.

BACKGROUND OF THE INVENTION

Almost all magnesium metal is made commercially by either of two major processes. When the magnesium-bearing ores — dolomite, magnesite or carnallite — are used, the metal is prepared by thermal reduction of the oxide in the presence of ferrosilicon or carbon. On the other hand, the other major route involves precipitation of the magnesium from undiluted seawater in the hydroxide form, hydrochlorination of the hydroxide back to the chloride form and electrolysis of the molten magnesium chloride.

Despite the widespread use of these processes, recent upward surges in the cost of the high energy requirements of these processes make them subject to replacement in certain instances, e.g. when particular sources of other raw materials are available at low cost and/or when energy requirements may be lessened markedly.

An example of the former situation is $MgCl_2$ which is produced as a byproduct in the manufacture of titanium metal by reduction of $TiCl_4$ with magnesium and/or sodium. In one such process, $TiCl_4$ is reduced with magnesium alone which yields $MgCl_2$ as a byproduct. In another such process, $TiCl_4$ is reduced partially with sodium followed by reduction of the subchloride ($TiCl_2$) with magnesium, which yeilds a byproduct mixture consisting of $MgCl_2$ and NaCl. In both cases the byproduct salts are anhydrous and remain so unless they are exposed to air for several minutes.

BRIEF SUMMARY OF THE INVENTION

The invention is therefore directed to a novel process for the manufacture of magnesium metal from $MgCl_2$-containing salts. More particularly, the invention is directed in one aspect to a process for the manufacture of magnesium metal comprising the steps a. forming a pool of magma from $MgCl_2$ and NaCl, the surface of which is blanketed with inert gas and in which the weight ratio of $MgCl_2$ to NaCl is from about 0.5 to about 2;
b. injecting sodium metal beneath the surface of the magma; and
c. withdrawing molen magnesium metal from the surface of the magma.

In a second aspect, the invention is directed to an apparatus in which to carry out the above-described process.

DETAILED DESCRIPTION OF THE INVENTION

Figure 1:
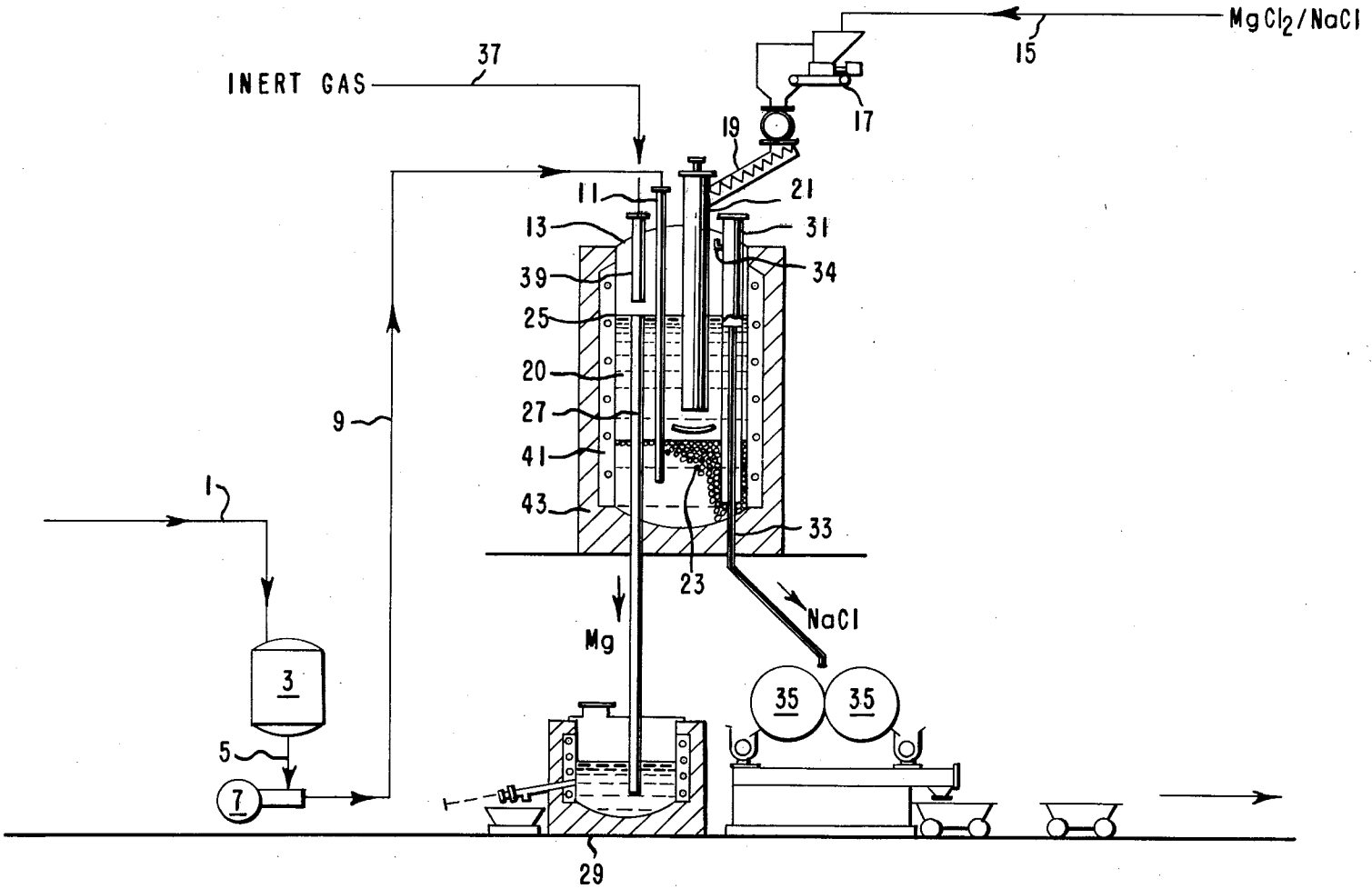

The fundamental chemical reaction which is used in the invention is well known, as follows:

$$2Na + MgCl_2 \rightarrow Mg + 2NaCl$$

This reaction when carried out with the reactants in the form of a magma, i.e. in molten condition, is rather highly exothermic depending upon the composition and temperature of the reactants as they are fed to the reactor. Consequently, the temperature at which the reactants are introduced into the reaction system is quite important from the standpoint of safety. In this regard, it has been found that the reactants must not be brought into contact when both are at high temperature. Thus, if molten sodium near its melting point (97.5° C) is to be fed into the magma at, say, 800°–825° C, the magma should contain no more than about 25% weight $MgCl_2$, the balance being NaCl, in order to limit the temperature rise of the system to an acceptable level. Conversely, if molten sodium alone is present in the reactor at 800°–825° C, no undue temperature rise will be experienced if $MgCl_2$ or mixtures of $MgCl_2$ and NaCl are added at room temperature. From the known heats of reaction of sodium and $MgCl_2$ and the heat contents of the reactants at various temperatures, one skilled in the art can readily determine the temperatures of the feed streams which will be suitable to avoid runaway reactions and violent vaporization of the sodium.

In accordance with the invention, it has been found that the safety of the process is improved still further if the molten reaction medium is diluted by means of an inert inorganic salt in which the molten $MgCl_2$ is soluble. Such salts must, of course, be non-volatile and have a melting point below about 880° C, the boiling point of sodium. Thus, NaCl (M.Pt. 800.4° C), NaBr (M.Pt. 391° C) and NaI (M.Pt. 651° C) would be suitable. However, NaF is unsuitable since its melting point is 992° C, which is above the boiling point of sodium. However, economic considerations overwhelmingly favor the use of NaCl and, as a practical matter, it is believed that NaCl will be used to the exclusion of the other salts except as they may be present as impurities.

Though the reaction can be conducted without dilution of the feed $MgCl_2$ with NaCl, a ratio of at least two moles NaCl per mole of $MgCl_2$ is preferred for reasons discussed hereinabove. On the other hand, for reasons of energy economy and reactor capacity, it is preferred to use not more than about four moles NaCl per mole $MgCl_2$.

It will be apparent to those skilled in the art that the melting point of the reactant mixture will vary depending upon the relative NaCl concentration of the reactants, thus the minimum operating temperatures of the process are a function of the magma composition. At an $MgCl_2$/NaCl ratio of 0.5, the magma melting point is about 525° C and at 2.0 the magma melting point is about 575° C. However, the process of the invention must be operated at 800.4° C, the melting point of NaCl, or higher, because of the gradients of NaCl concentration with the reactor system. In particular, at least about 800.4° C will be needed in order to maintain the spent magma, which is mainly NaCl, in a sufficiently fluid state that it can be readily separated from the magnesium metal product and that it can be removed by gravity flow from the reactor. For these reasons, a magma temperature of 800° to 850° C is preferred and 820° to 830° C is especially preferred.

The process of the invention can be carried out batchwise, intermittently or continuously. However, it is clear that the economics of the process favor intermittent and especially continuous operation. When the process is carried out in an intermittent or continuous manner, it is necessary that the above-described fundamental process be carried out by performing the following steps in an intermittent or continuous manner, respectively:

a. injecting molten sodium metal beneath the surface of the magma;

b. withdrawing molten magnesium metal from the surface of the magma;
c. withdrawing magma; and
d. adding $MgCl_2$ and NaCl in the weight ratio of about 0.5 to about 2 at a rate sufficient to maintain the amount and overall composition of the magma substantially constant.

Upon injecting the sodium, preferably in molten form, beneath the surface of the $MgCl_2$/NaCl mixture, it is very rapidly dissolved therein and heated to the desired temperature of 800° to 850° C. The resultant molten magnesium metal is thus formed within the magma and is then separated therefrom by rising to the inert gas-blanketed surface of the magma from which it can be removed by skimming or overflow.

The spent magma, which consists mainly of NaCl, must, of course, be removed at a rate which will be determined by the rates of raw material addition and magnesium removal. Because the difference between the densities of molten NaCl and molten magnesium metal is only about 5–8% at 800°–825° C, it will normally be preferred to take precautions to insure adequate separation of the products. In order to minimize carryover of magnesium into the magma, it is necessary to remove the magma without any turbulence which would tend to redisperse magnesium globules as they are formed in the magma. For this reason, too, it is preferred to employ, at least in the lower part of the magma, a high surface area coalescing medium such as ball bearings or mesh made of steel or other inert material which is wetted by molten magnesium. It is still further preferred that the ratio of the depth of the magma to its width be at least about 1:1 in order that the magnesium globules have sufficient length of travel up through the magma to provide additional coalescense and further avoid carryover of salt into the magnesium layer. For this reason, it is preferred that the ratio of the length (depth) of the magma zone of the reactor to its diameter (L/D ratio) be at least about 1:1 and preferably from about 1.5:1 to about 5:1.

Even though the reaction is carried out in the molten phase, the reactants do not have to be fed to the process in molten condition. Thus, the magma components, $MgCl_2$ and NaCl, will usually be fed to the process in granular form from which they are quickly melted when they are introduced into the magma. Likewise, the sodium can be added to the process in either solid or molten form. However, because it is both easier and safer to handle metallic sodium in molten form, it is preferred to use it in that form. This, of course, also produces better heat and mass transfer conditions within the reactor.

It is essential that both the $MgCl_2$ and NaCl be free of moisture when they are added to the process because moisture picked up by either will result in contamination of the magnesium with oxide. Procedures to avoid both moisture and air must also be followed in handling sodium. Furthermore, it is essential that the unfilled space in the top of any reaction zone be filled with inert gas such as helium or argon, thus blanketing the magma surface or the layer of magnesium metal which will cover the magma surface.

Suitable materials of construction for the reactor to be used in the process of the invention include iron, aluminum-coated iron, chrome steek, titanium, alumina, silicon carbide and graphite. In the case of the coalescing medium, however, it is necessary that the molten magnesium wet the coalescing surface. For this reason, iron and iron alloys are preferred as the material of construction for the coalescing medium.

Conversely, the following listed materials are known to be attacked strongly by liquid magnesium within 2 or 3 hours at 900° C and therefore unsuitable as materials of construction for the reactor: alundum, beryllia, magnesia, porcelain, quartz and zirconia.

It will be apparent to those skilled in the art that the operation of the process must be conducted in such manner as to avoid the precipitation of any of the reactants in the reactor. In particular, it is necessary to keep the temperature of the magma at about 800° C or above to avoid localized precipitation of NaCl as the composition of the magma becomes locally depleted in $MgCl_2$ and enriched in NaCl by separation of molten magnesium metal from the magma.

Because of the exothermic character of the reaction between $MgCl_2$ and sodium which is a direct function of the temperature, the process of the invention can be run under heat balanced conditions by which part of the evolved heat is absorbed in heating and melting the reactants when they are added to the reactor and the remaining heat (excluding heat losses through vessel walls) is removed by withdrawal of magnesium and spent magma. By adjustment of feed rates, withdrawal rates and ratio of reactants, a wide range of reaction conditions is possible. Thus, when the process is carried out continuously, an extraneous source of heat for melting the reactants may be required only for preparing the initial charge of reactants. A heat source for start-up does not therefore have to be an integral part of the reaction vessel. However, a heat source can be incorporated into the reaction vessel if desired. For example, electric heating elements can be affixed to the outer surface of the walls of the reactor. In virtually all instances, the reactor will be insulated for the purposes of safety and to decrease radiation losses.

The invention will be better understood by reference to the Drawing which consists of two figures.

In FIG. 1 a preferred manner of carrying out the process continuously is represented schematically.

Figure 2:
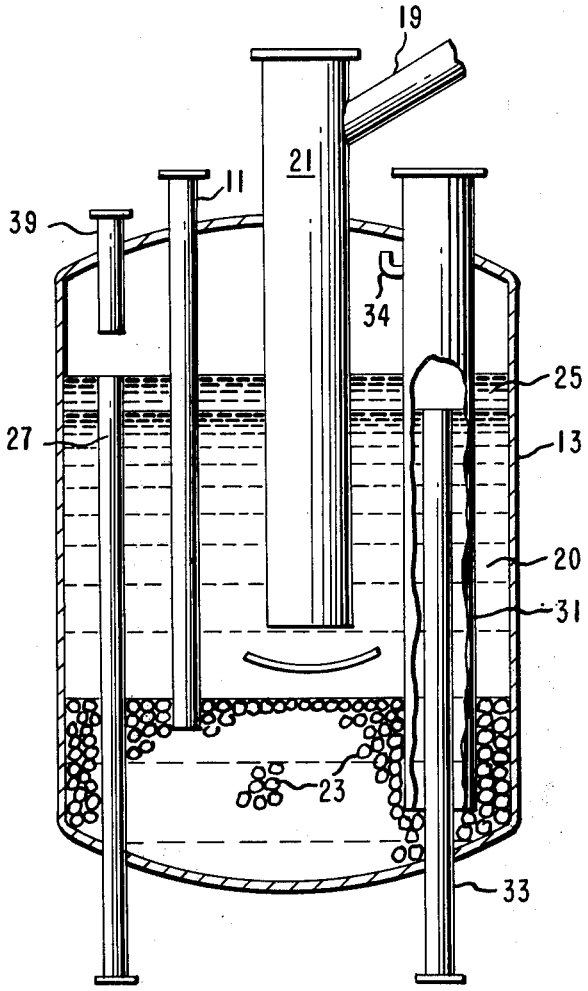

In FIG. 2, the preferred reaction vessel configuration, as set forth in FIG. 1, is presented in enlarged form to facilitate understanding of details.

Referring now to FIG. 1 of the Drawing, molten sodium is passed from storage through line 1 to a weigh tank 3 in which 2370 lbs/hr of sodium are measured and discharged through pump intake line 5. The metered amount of sodium is pumped via sodium pump 7 through sodium feed line 9 and sodium inlet pipe 11 which discharges the molten sodium into a coalescing zone in the bottom of reactor 13. Simultaneously, a 1.35:1 weight ratio mixture of $MgCl_2$ and NaCl in granular form is passed from storage by means of solids conveyor line 15 to weigh feeder 17 in which 8520 lbs/hr of the salt mixture are measured and discharged through closed screw conveyor 19 through granular solids inlet line 21 which discharges the granulated salt mixture into reactor 13. Both the molten sodium and granulated salt mixture are discharged into magma pool 20. The bottom zone of reactor 13 below the level of the salt inlet 21 is filled with coalescing medium 23, which in this case is steel balls. As the molten sodium becomes diffused into the magma, it reacts with the $MgCl_2$ forming magnesium metal which rises through the magma and forms a layer of magnesium 25 atop the magma 20. The upper level of the layer is defined by the level of the inlet to upper outlet pipe 27 through which molten magnesium is withdrawn by overflow to holding pot 29 from which the molten magnesium metal is withdrawn for casting at a rate of 1250 lbs/hr.

Spent magma, that is, magma consisting essentially of NaCl and about 0.5% wt. $MgCl_2$, passes from the bottom of the coalescing zone into a vented outlet pipe 31 in which is positioned concentrically an open standpipe 33, the inlet of which defines the upper level of the magma. Outlet pipe 33 is vented into the vapor space of the reactor via vent pipe 34. The spent magma is withdrawn by overflow through standpipe 33 at the rate of 9640 lbs/hr through cooling means (not shown) and flaker 35 in which the spent magma is solidified and discharged for further cooling and disposal. A portion of the solidified magma can be admixed with feed $MgCl_2$ for recycle to the process.

Blanketing of the magnesium layer is accomplished by admitting argon gas through inert gas line 37 and gas inlet pipe 39 and maintaining a slight pressure of inert gas in the top of the reactor during all operations.

The above-described continuous process can be started up by purging the reactor system with inert gas, charging the reactor with a mixture of $MgCl_2$ and NaCl and then activating electric heating elements 41, which are affixed to the outer wall of the reactor and are surrounded by insulation 43, to heat the salt mixture to the melting temperature of NaCl (800.4° C). Once the mixture of $MgCl_2$ and NaCl becomes molten, continuous injection of molten sodium can be initiated and slowly increased. As the exotherm from reaction of the sodium is produced, the amount of power to the heaters is reduced until the process becomes thermally balanced, at which time continuous feeding of $MgCl_2$ or $MgCl_2$/NaCl mixture and continuous withdrawal of spent magma are initiated. The foregoing described start-up procedure is particularly preferred since it avoids completely any release of sodium vapors into any of the vapor spaces of the reactor and connecting lines.

We claim:

1. A process for the manufacture of magnesium metal comprising a. forming a pool of magma from $MgCl_2$ and NaCl, the surface of which is blanketed with inert gas and in which the weight ratio of $MgCl_2$ to NaCl is from about 0.5 to about 2;

b. injecting sodium metal beneath the surface of the magma; and c. withdrawing molten magnesium metal from the surface of the magma.

2. The process of claim 1 in which magma is withdrawn through a high surface area coalescing medium.

3. The process of claim 2 in which the manufacture of magnesium metal is carried out intermittently or continuously by performing the following steps in an intermittent or continuous manner:

a. injecting molten sodium metal beneath the surface of the magma;

b. withdrawing molten magnesium metal from the surface of the magma;

c. withdrawing magma; and d. adding $MgCl_2$ and NaCl at a weight ratio and rate sufficient to maintain the amount and composition of the magma substantially constant.

4. The process of claim 1 in which the average temperature of the magma is from about 800° C to about 850° C.

5. The process of claim 4 in which the average temperature of the magma is from about 820° C to about 830° C.

6. The process of claim 3 carried out under heat balanced conditions without the addition of extraneous heat.

7. The process of claim 1 in which the $MgCl_2$ and NaCl are granular solids.

8. The process of claim 3 in which magma withdrawn from the process is solidified, admixed with $MgCl_2$ and recycled to the process.

* * * * *